US009341156B2

(12) United States Patent
Nakamura et al.

(10) Patent No.: US 9,341,156 B2
(45) Date of Patent: May 17, 2016

(54) GLOW PLUG, NEW GLOW PLUG DETERMINATION METHOD, AND GLOW PLUG DRIVING CONTROL DEVICE

(75) Inventors: Tomohiro Nakamura, Saitama (JP); Yutaka Tanaka, Saitama (JP); Yoshihito Fujishiro, Saitama (JP); Yasuo Toyoshima, Saitama (JP)

(73) Assignee: Bosch Corporation, Tokyo (JP)

( * ) Notice: Subject to any disclaimer, the term of this patent is extended or adjusted under 35 U.S.C. 154(b) by 289 days.

(21) Appl. No.: 14/118,918

(22) PCT Filed: May 14, 2012

(86) PCT No.: PCT/JP2012/062262

§ 371 (c)(1),
(2), (4) Date: Nov. 20, 2013

(87) PCT Pub. No.: WO2012/161007

PCT Pub. Date: Nov. 29, 2012

(65) Prior Publication Data

US 2014/0096733 A1 Apr. 10, 2014

(30) Foreign Application Priority Data

May 20, 2011 (JP) ..... 2011-112993

(51) Int. Cl.

| | |
|---|---|
| ***F02P 19/02*** | (2006.01) |
| ***F23Q 7/00*** | (2006.01) |
| *F02D 41/26* | (2006.01) |
| *F02D 41/20* | (2006.01) |

(52) U.S. Cl.

CPC ..... *F02P 19/02* (2013.01); *F02P 19/027* (2013.01); *F23Q 7/001* (2013.01); *F02D 41/266* (2013.01); *F02D 2041/2058* (2013.01)

(58) Field of Classification Search

CPC ..... F02D 2041/2058; F02D 41/266; F02D 35/025; F02P 19/027; F02P 17/12; F02P 19/025; F02P 19/02

USPC ..... 324/393–402, 713; 123/179.21

See application file for complete search history.

(56) References Cited

U.S. PATENT DOCUMENTS 3,480,374 A * 11/1969 Lamb ..... F23Q 3/00 361/84
4,306,853 A * 12/1981 Rippelmeyer ..... F23Q 7/10 431/254

FOREIGN PATENT DOCUMENTS

| | | |
|---|---|---|
| JP | 3271781 | 12/1991 |
| JP | 9218619 | 8/1997 |
| JP | 2002095154 | 3/2002 |
| JP | 2008106702 | 5/2008 |
| JP | 2009036092 | 2/2009 |
| JP | 2010127487 | 6/2010 |

OTHER PUBLICATIONS

International Search Report for Application No. PCT/JP2012/062262 dated Jul. 10, 2012 (English Translation, 2 pages).

* cited by examiner

*Primary Examiner* — Vincent Q Nguyen
(74) *Attorney, Agent, or Firm* — Michael Best & Friedrich LLP

(57) ABSTRACT

A glow plug is provided that can be easily determined as to whether or not it is a new article. An additional circuit formed by connecting a diode, a fuse, and an adjusting resistor in series in this order is connected in parallel to a heating element of a glow plug. The diode is provided so as to have an anode located on the positive electrode side of the heating element and a cathode located on the fuse side. In the case of a unit inspection, by applying a positive voltage for test to a heating element negative electrode connecting portion, it is possible to determine whether or not the glow plug is normal without blowing the fuse before the glow plug is used in a vehicle.

6 Claims, 6 Drawing Sheets

GLOW PLUG, NEW GLOW PLUG DETERMINATION METHOD, AND GLOW PLUG DRIVING CONTROL DEVICE

BACKGROUND OF THE INVENTION

The present invention relates to a glow plug used in a diesel engine or the like, and in particular, to further improvement of the reliability of a glow plug and a vehicle based on providing a new glow plug, which can be easily determined as to whether or not it is a new article at the time of replacement, and providing a new article determination method.

The quality of a glow plug used in a diesel engine or the like may have a large influence on a startup of a diesel engine or the like. For this reason, various devices for detecting the deterioration have been proposed and put to practical use up to now. For example, a method of determining the presence or absence of deterioration on the basis of a change in the resistance of a heater has been proposed (for example, refer to JP-A-2009-191842).

Incidentally, it cannot be determined at a glance whether or not a glow plug is a new article, in many cases, due to its structure. Therefore, for some reason at the time of replacement or the like, there is a possibility that a deteriorated article will be erroneously mounted as a new article.

However, conventionally, there has been no method or device capable of reliably and relatively easily determining whether or not a glow plug is a new article.

For example, although there is a method of determining the presence or absence of deterioration on the basis of the amount of change in the resistance as described above, this method cannot be applied as it is for determination regarding whether or not a glow plug is a new article. That is, with only the amount of change in the resistance, it is determined that there is no deterioration if the amount of change satisfies the specification of so-called on-board diagnostics (OBD) which is a self-diagnostic function system of the vehicle. Eventually, it is not possible to determine whether or not a glow plug is a new article.

SUMMARY OF THE INVENTION

The invention has been made in view of the above situation, and is intended to provide a new glow plug that can be easily determined as to whether or not it is a new article.

In addition, it is another object of the invention to provide a simple inspection method effective for a glow plug having a new configuration.

In addition, it is still another object of the invention to provide a new glow plug determination method in a state where the glow plug is mounted in a vehicle.

According to a first aspect of the invention, there is provided a glow plug including an additional circuit connected in parallel to a heating element of the glow plug, the additional circuit being formed by connecting a diode, a fuse, and a resistor in series in this order. The diode is provided so as to have an anode located on a positive electrode side of the heating element and a cathode located on the fuse side.

According to a second aspect of the invention, there is provided a unit testing method of a glow plug in which an additional circuit formed by connecting a diode, a fuse, and a resistor in series in this order is connected in parallel to a heating element of the glow plug and the diode is provided so as to have an anode located on a positive electrode side of the heating element and a cathode located on the fuse side. The unit testing method of a glow plug includes: applying a positive test voltage to a negative electrode side of the heating element; and performing quality determination using a current, which flows during the application of the positive test voltage, without blowing the fuse.

According to a third aspect of the invention, there is provided a new article determination method for an in-vehicle glow plug in which an additional circuit formed by connecting a diode, a fuse, and a resistor in series in this order is connected in parallel to a heating element and the diode is provided so as to have an anode located on a positive electrode side of the heating element and a cathode located on the fuse side. The new article determination method includes: acquiring and storing, at the time of first power application after the glow plug is mounted in a vehicle, a change of a power state when an inrush current is generated and when the fuse is blown; acquiring, at the time of power application after the glow plug is replaced, a change of a power state at the same timing as when the inrush current is generated and when the fuse is blown; and comparing each acquired change of a power state with the stored change of a power state at the time of first power application to determine whether or not the glow plug is a new article.

According to a fourth aspect of the invention, there is provided a glow plug driving control device including: an arithmetic control unit that performs driving control of a glow plug; and a power driving circuit that powers the glow plug up according to the glow plug driving control performed by the arithmetic control unit. In the glow plug, an additional circuit formed by connecting a diode, a fuse, and a resistor in series in this order is connected in parallel to a heating element, and the diode is provided so as to have an anode located on a positive electrode side of the heating element and a cathode located on the fuse side. At the time of first power application after the glow plug is mounted in a vehicle, a change of a power state when an inrush current is generated and when the fuse is blown is acquired and stored. At the time of power application after the glow plug is replaced, each change of a power state is acquired at the same timing as when the inrush current is generated and when the fuse is blown. Each acquired change of a power state is compared with the stored change of a power state at the time of first power application to determine whether or not the glow plug is a new article.

BRIEF DESCRIPTION OF THE DRAWINGS

FIG. 4 is a circuit diagram showing a circuit connection when a new glow plug determination method according to the embodiment of the invention is performed by a glow plug driving control device, where

DETAILED DESCRIPTION

Hereinafter, an embodiment of the invention will be described with reference to FIGS. 1 to 7.

It will be noted that the members and arrangements described below are not intended to limit the present invention and can be variously modified within the scope of the gist of the present invention.

First, the mechanical configuration of a glow plug according to the embodiment of the invention will be described with reference to FIG. 1.

Figure 1:
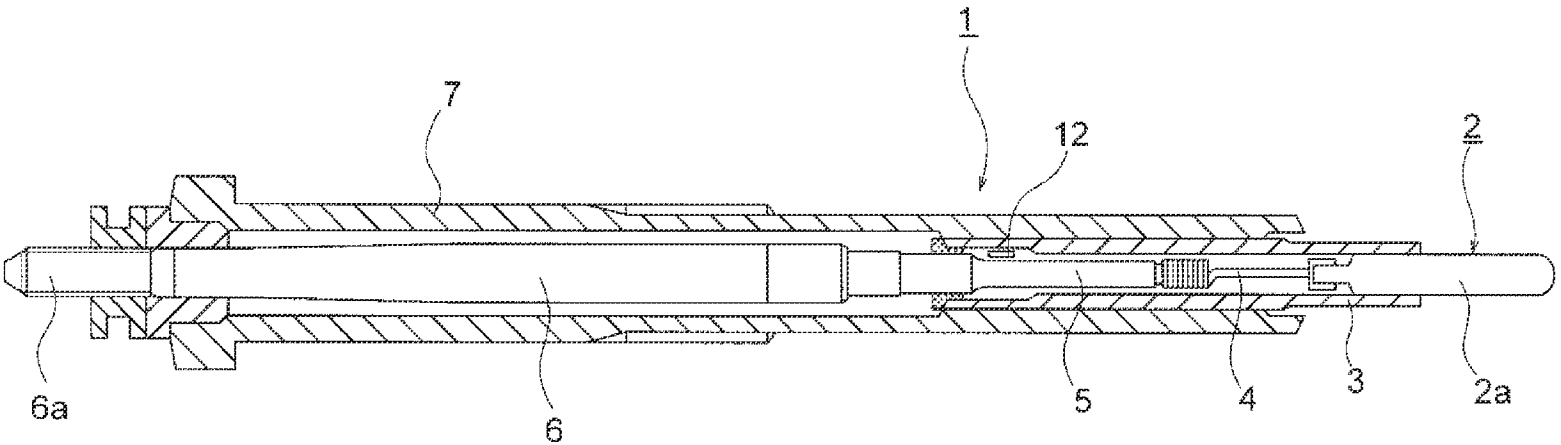
FIG. 1 is a longitudinal sectional view showing the overall schematic configuration of a glow plug according to an embodiment of the invention.

The glow plug shown in FIG. 1 is a configuration example of a ceramic type glow plug, and the basic configuration is almost the same as those conventionally known except that a new electrically component not present in the related art is added as will be described later. Accordingly, the configuration shown in FIG. 1 will be schematically described.

A glow plug 1 is formed by inserting and fixing a ceramic heater 2, a metal outer cylinder 3, an electrode lead-out line 4, and a first electrode rod 5, and a second electrode rod 6 into a housing 7.

The ceramic heater 2 is formed by embedding a heating element (not shown) inside a ceramic insulator 2*a*, and the negative electrode side of the heating element is taken out to the outer peripheral surface of the ceramic insulator 2*a* so as to be electrically connected to the metal outer cylinder 3.

On the other hand, on the positive electrode side of the above-described heating element (not shown), a threaded portion 6*a* of the second electrode rod 6 protruding from the rear end side of the housing 7 is connected to a battery (not shown) through the electrode lead-out line 4, the first electrode rod 5, and the second electrode rod 6 that are formed of a conductive member.

In the glow plug 1 according to the embodiment of the invention, in addition to basically the same configuration as the conventional configuration described above, an additional circuit 12 is provided at an appropriate position of the gap between the first electrode rod 5 and the metal outer cylinder 3, for example.

The additional circuit 12 has a circuit configuration to be described later. For example, it is preferable to build a circuit by forming an electronic component, which will be described later, on a sheet-like insulating substrate using thin film semiconductor technique, for example.

Figure 2:
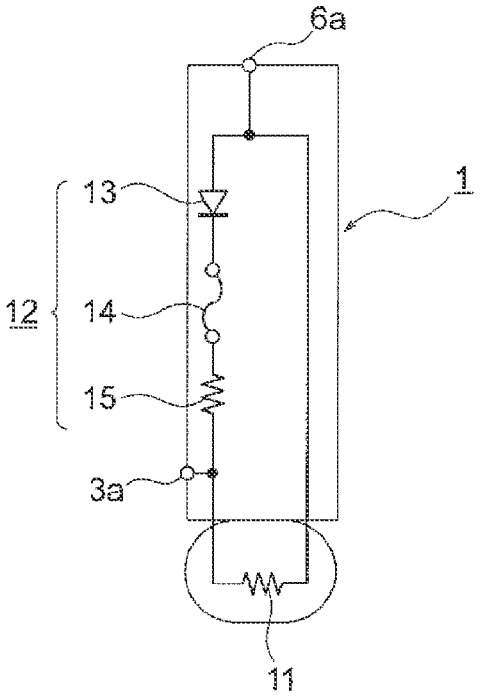
FIG. 2 is a circuit diagram showing an example of the configuration of an electrical circuit of the glow plug according to the embodiment of the invention.

FIG. 2 shows an example of the configuration of an electrical circuit of the glow plug 1 according to the embodiment of the invention, and this diagram will be described below.

First, as described above, the negative electrode side of a heating element 11 is connected to a heating element negative electrode connecting portion 3*a* of the metal outer cylinder 3 (refer to FIG. 1), and the other end is connected to the threaded portion 6*a* through the electrode lead-out line 4, the first electrode rod 5, and the second electrode rod 6 (refer to FIG. 1; not shown in FIG. 2). Therefore, the heating element 11 is connected in series between the heating element negative electrode connecting portion 3*a* and the threaded portion 6*a*.

This configuration is basically the same as the conventional glow plug.

In the glow plug 1 according to the embodiment of the invention, the additional circuit 12 is further provided so as to be connected to the heating element 11 in parallel.

That is, the additional circuit 12 is formed by connecting a diode 13, a fuse 14, and an adjusting resistor 15 in series from the threaded portion 6*a* side.

An anode of the diode 13 is connected to, for example, an appropriate position of the first electrode rod 5 (refer to FIG. 1) so as to be electrically connected to the positive electrode side of the heating element 11 and finally to the threaded portion 6*a*, and a cathode of the diode 13 is connected to one end of the fuse 14 (refer to FIG. 2).

In addition, the other end of the fuse 14 and one end of the adjusting resistor 15 are connected to each other, and the other end of the adjusting resistor 15 is connected to the heating element negative electrode connecting portion 3*a*.

Next, a unit testing method in the production process of the glow plug 1 having the above configuration will be described with reference to FIG. 3.

Figure 3:
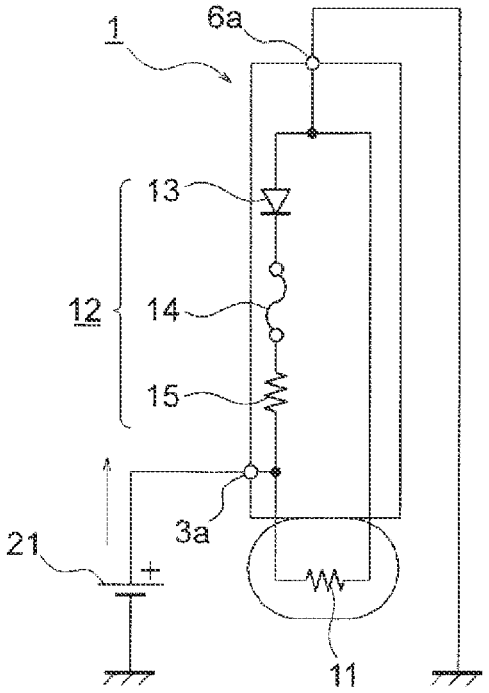
FIG. 3 is a circuit diagram showing a circuit connection during the inspection of the glow plug unit according to the embodiment of the invention.

During unit testing, in contrast to the related art, the positive electrode side of a power supply 21 for a test is connected to the heating element negative electrode connecting portion 3*a*, and the negative electrode side of the power supply 21 is connected to the threaded portion 6*a* and the ground (refer to FIG. 3).

In this connection, the diode 13 is in a non-conductive state since a reverse voltage is applied. For this reason, a current flows only through the heating element 11 and does not flow through the additional circuit 12. Therefore, the fuse 14 is not blown in a unit inspection.

In this unit testing, the voltage of the power supply 21 is specified in advance. At the same time, at this applied voltage, a current flowing only through the heating element 11 is calculated in advance and is defined as a reference current. Depending on whether or not the reference current is obtained, quality determination is performed.

Usually, the resistance of the heating element 11 is specified on the basis of the specifications of the glow plug 1 prior to production. Accordingly, if the voltage of the power supply 21 is specified, a current in the normal state is determined. Therefore, the current value is a reference for determining the quality in the above-described inspection, and it is general to set the allowable range with the current value as the center and to perform determination as a non-defective article if the value is within the allowable range.

In addition, although the current measurement is not shown in FIG. 3, it is preferable to perform the current measurement by connecting an ammeter between the threaded portion 6*a* and the ground in series.

Next, a new glow plug determination method of the embodiment of the invention in a state where the glow plug 1 is mounted in a vehicle will be described with reference to FIGS. 4 to 6.

First, a circuit configuration in a state where the glow plug 1 is mounted in a vehicle will be described with reference to FIG. 4(A).

The heating element negative electrode connecting portion 3*a* of the glow plug 1 is connected to the ground, and the threaded portion 6*a* is connected to the positive electrode side of a vehicle battery 22 through a glow plug driving control device (hereinafter, referred to as a "GCU") 100.

The GCU 100 is configured so as to be largely divided into a power driving circuit 31, a current measuring circuit 32, and an arithmetic control unit (denoted as a "CPU" in FIG. 4) 33.

The power driving circuit 31 is configured to perform power control of the glow plug 1 by using a semiconductor element for power control 35 and a resistor 36 as main components.

For example, a MOSFET is used as the semiconductor element for power control 35. The drain is connected to the positive electrode of the vehicle battery 22, the source is connected to the threaded portion 6*a* of the glow plug 1 through the resistor 36, and a control signal from the arithmetic control unit 33 is applied to the gate, so that conduction and non-conduction of the semiconductor element for power control 35 are controlled. By conduction control of the semiconductor element for power control 35, power control of the glow plug 1 is performed. In addition, the power control using the power driving circuit 31 and the arithmetic control unit 33 is basically the same as that conventionally known.

The current measuring circuit 32 is configured to be able to input a voltage drop in the resistor 36, which is proportional to the current flowing through the glow plug 1, to the arithmetic control unit 33 by using an operational amplifier 37 and an analog-to-digital converter 38 as main components.

A voltage between both ends of the resistor 36 is input to the operational amplifier 37, and the output voltage of the operational amplifier 37 is input to the arithmetic control unit 33 as a digital value by the analog-to-digital converter 38.

The arithmetic control unit 33 divides the value of the voltage drop in the resistor 36, which has been input as a digital value as described above, by the resistance of the resistor 36 using a predetermined operational expression and stores the division result in an appropriate storage region as a current flowing through the glow plug 1.

For example, the arithmetic control unit 33 includes a microcomputer (not shown) as a main component, which has a known configuration, and a storage element (not shown), such as a RAM or a ROM, and also includes an interface circuit (not shown) for outputting a control signal for the semiconductor element for power control 35 or the like as a main component.

Next, the outline of the new glow plug determination method according to the embodiment of the invention will be described first and then will be described in detail.

First, this new glow plug determination method is suitable for determining whether or not a glow plug mounted in a vehicle is the glow plug 1 having a configuration described with reference to FIGS. 1 and 2.

In this new article determination method, the GCU 100 acquires and stores a current change when the glow plug 1 is first powered up. Then, when the glow plug 1 is replaced, determination regarding whether or not the newly mounted glow plug is a glow plug having a configuration shown in FIGS. 1 and 2 is performed by comparing the current flowing through the replaced glow plug with the current data stored in the GCU 100.

Next, the specific procedure of acquisition and storage of a current change at the time of first power application to the glow plug 1 will be described with reference to the configuration example shown in FIG. 4(A) and the sub-routine flowchart shown in FIG. 5.

First, as a prerequisite, it is assumed that the GCU 100 performs power driving control processing of the glow plug 1 as in the related art. The power driving control processing is to control the power application to the glow plug 1 according to the driving state of an engine (not shown). In other words, the power driving control processing is to control the conduction and non-conduction of the semiconductor element for power control 35. In the power driving control processing, the conduction and non-conduction of the semiconductor element for power control 35 are performed by pulse width modulation (PWM) control, for example.

Figure 5:
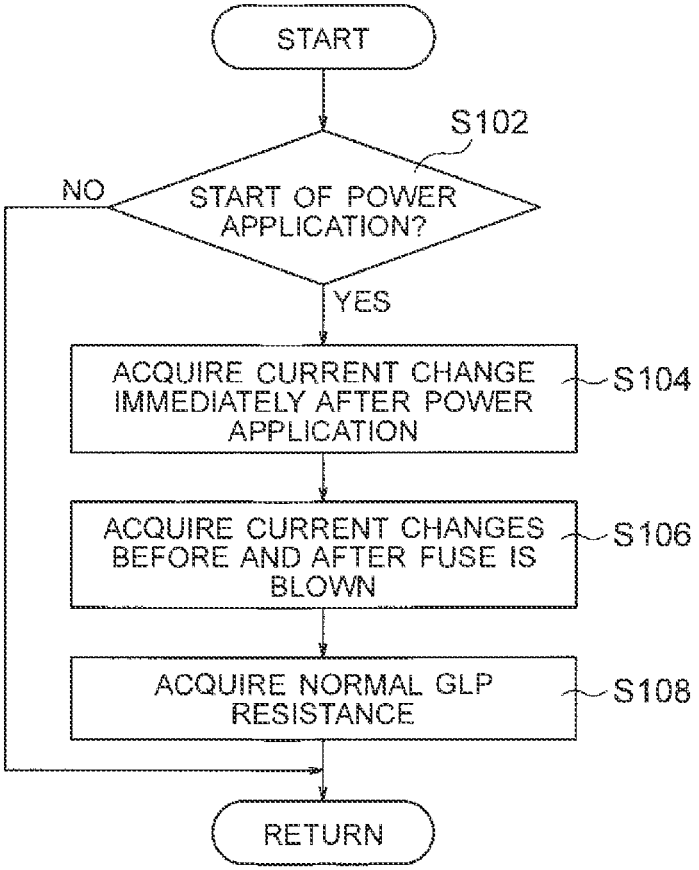
FIG. 5 is a subroutine flowchart showing the procedure of a new glow plug determination process according to the embodiment of the invention that is performed by a glow plug control unit when a new glow plug is first used.

The subroutine flowchart shown in FIG. 5 is intended to be executed by the arithmetic control unit 33 at the time of first power application to the glow plug 1 mounted in a vehicle, as one subroutine processing while the power control processing on the glow plug 1 is being performed according to the conventional processing procedure described above.

Then, when the process is started by the arithmetic control unit 33, it is determined whether or not first power application to the glow plug 1 has been started (step S102 in FIG. 5). When it is determined that this is a first power application (in the case of YES), the process proceeds to step S104 to be described below. When it is determined that this is not a first power application (in the case of NO), the process is ended without performing the series of processing and returns to the main routine (not shown).

In addition, for the determination regarding the first power application, for example, a method using a flag is preferable.

That is, a method is preferable in which the arithmetic control unit 33 sets a flag for first power application determination to a predetermined value, for example, "1" when mounting the glow plug 1 in the manufacturing stage of a vehicle and shipping it and determination as a first power application can be made if the flag for first power application determination is "1" during the execution of step S102. In addition, in this case, it is assumed that the flag for first power application determination is reset to "0" after the determination as a first power application.

In step S104, a change in the applied current of the glow plug 1 immediately after power application is read to the arithmetic control unit 33 through the current measuring circuit 32, and is stored in the appropriate storage region of the arithmetic control unit 33.

Here, the operation of the glow plug 1 of the invention will be described with reference to FIG. 7.

First, the glow plug 1 according to the embodiment of the invention blows the fuse 14 at the time of first power application. Then, in the same manner as in a glow plug having a conventional configuration, the glow plug 1 is used in a state where a current flows only through the heating element 11.

At the start of first power application, the fuse 14 is connected in parallel to the heating element 11 together with the diode 13 and the adjusting resistor 15. Accordingly, since the resistance as a whole becomes lower than that in the case of only the heating element 11, a larger inrush current than in the case of only the heating element 11 flows. For this reason, the fuse 14 that can be reliably blown by the inrush current is selected. In addition, the current necessary for blowing the fuse 14 can be adjusted to have a desired magnitude by appropriately selecting the resistance of the adjusting resistor 15.

Figure 7:
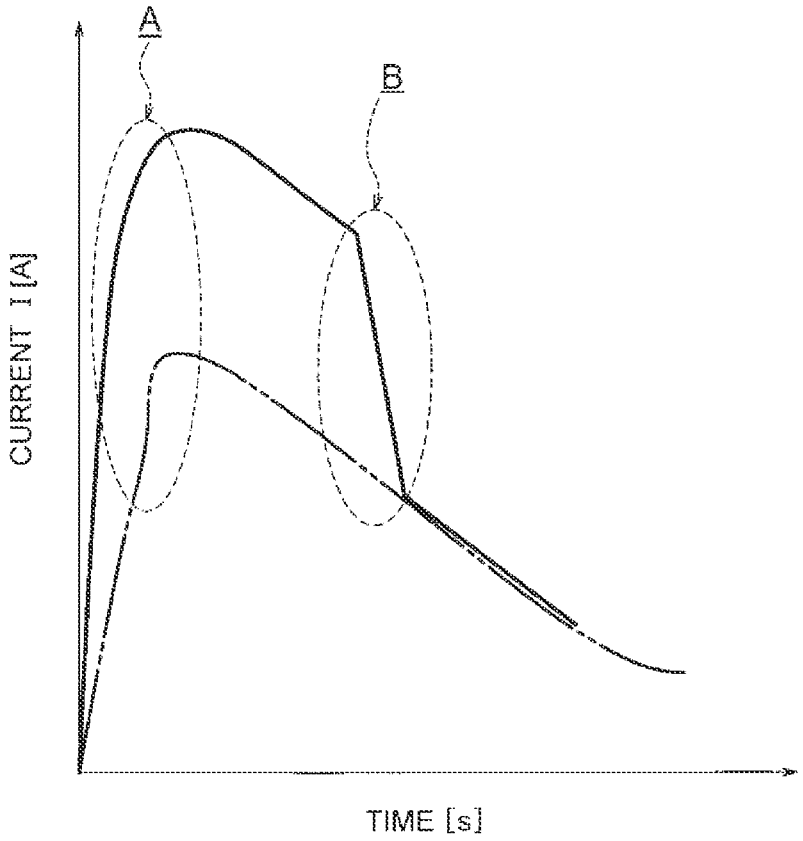
FIG. 7 is a characteristic line diagram showing a characteristic line, which shows an example of a current change with respect to the power-on time when the glow plug according to the embodiment of the invention is first used, and a characteristic line, which shows an example of a current change with respect to the power-on time in a conventional glow plug.

FIG. 7 shows an example of the characteristic line (solid characteristic line), which indicates a change in the applied current at the time of first power application to the glow plug 1, together with an example of the same characteristic line (characteristic line of two-dot chain line) of a glow plug having a conventional configuration.

In this diagram, a portion surrounded by the dotted circle with the reference sign A is a current change at the start of power application. In the case of the glow plug 1, compared with the related art, not only is the peak value of the current large, but also the ratio of current change with respect to the passage of time (current change rate) is large. That is, in other words, it can be confirmed that the slope of the rising of the characteristic line is large. In addition, the current that flows with a large current change rate and a large peak value at the start of power application as described above is called an "inrush current".

At the start of such power application, the heating element 11 is not heated yet, and the resistance is relatively low. Accordingly, since most of the inrush current flows to the heating element 11 side, the fuse 14 is not blown at this point in time.

When the above-described inrush current flows and then the heating element 11 begins to generate heat, the current flowing through the entire glow plug 1 gradually decreases with an increase in the resistance of the heating element 11 (refer to FIG. 7). However, the current flowing to the fuse 14 side is increased compared with the current flowing through the heating element 11. As a result, the fuse 14 is blown at a certain point in time, and the applied current drops at once to become a current that is approximately the same as that in a conventional article (refer to a portion of a dotted circle with the reference sign B in FIG. 7).

Then, in step S104, a current value with respect to the passage of time from the start of power application in the range of the dotted circle with the reference sign A in FIG. 7 is acquired at a predetermined sampling timing and is stored in the appropriate storage region of the arithmetic control unit 33.

Incidentally, the sampling duration time from the start of power application and the sampling interval should be appropriately selected depending on the difference in the electrical characteristics, such as the difference in the magnitude of the inrush current of the glow plug 1 used. These values do not need to be limited to specific values, and are preferably set on the basis of test results, simulation results, and the like.

Then, in step S106, current changes before and after the fuse is blown are acquired.

That is, in FIG. 7, a current value with respect to the passage of time in a portion surrounded by the dotted circle with the reference sign B is sampled and stored in the appropriate storage region of the arithmetic control unit 33 as in step S102.

In addition, for example, a point in time when the current value becomes equal to or greater than a predetermined value after the start of the current drop after the inrush current described above in FIG. 7 flows is set as the start time of the sampling in step S106, or a point in time when the elapsed time from the start of power application reaches a predetermined time is set as the start time of the sampling in step S106. Thus, the start time of the sampling in step S106 can be selected in various ways, and does not need to be limited to specific methods.

In addition, a point in time when the current value becomes equal to or less than a predetermined value is set as the end time of the sampling in step S106, or a point in time when a predetermined time has passed from the start of sampling is set as the end time of the sampling in step S106. Thus, the end time of the sampling in step S106 can be selected in various ways in the same manner as for the start time of the sampling, and does not need to be limited to specific methods.

After performing the processing of step S106 as described above, the resistance of the glow plug 1 after the passage of a certain period of time is acquired (refer to step S108 in FIG. 5). In addition, in step S108 in FIG. 5, "GLP" means a glow plug.

That is, the resistance of the glow plug 1 is calculated as follows by the arithmetic control unit 33.

That is, assuming that the voltage drop in the semiconductor element for power control 35 can be neglected, the arithmetic control unit 33 calculates the resistance Rg of the glow plug 1 by executing $Rg=(VB-Vr)\div(Vr\rightarrow R)$, where the resistance of the resistor 36 is R, the voltage drop in the resistor 36 acquired through the current measuring circuit 32 is Vr, and the voltage of the vehicle battery 22 is VB.

In addition, the resistance Rg of the glow plug 1 calculated as described above is stored in the appropriate storage region of the arithmetic control unit 33 together with the data obtained in steps S104 and S106, and the series of processing is ended.

Next, new article determination processing performed by the arithmetic control unit 33 when a glow plug is replaced will be described with reference to FIGS. 4(B) and 6.

Figure 4B:
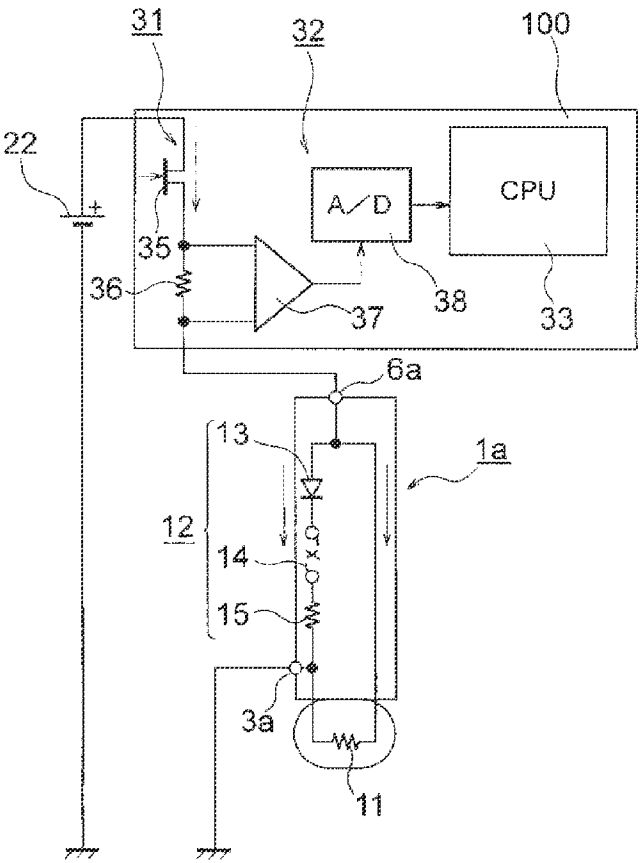
FIG. 4(A) is a circuit diagram showing a connectable state before a fuse is blown and FIG. 4(B) is a circuit diagram showing a connection state before a fuse is blown.
Figure 4A:
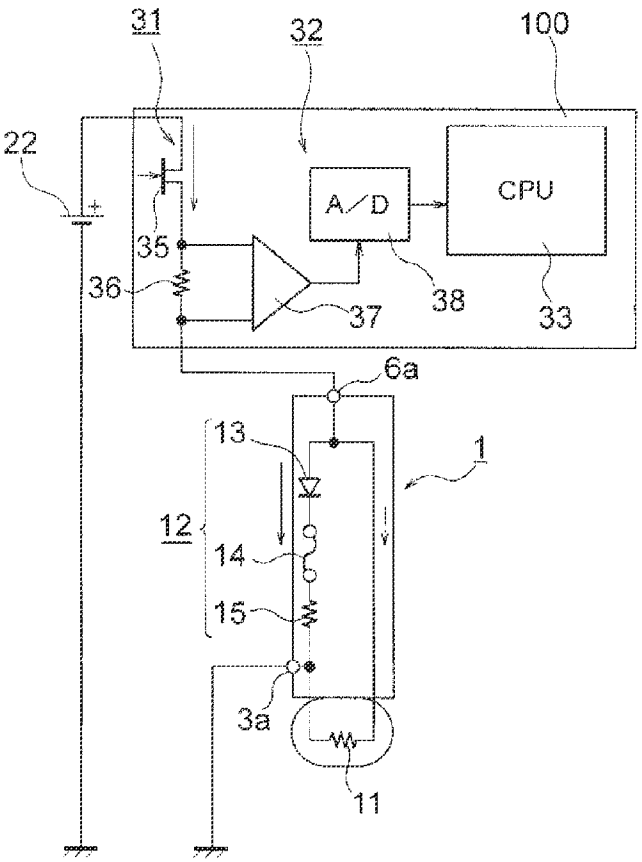

First, the procedure of new article determination processing will be described below on the assumption that the glow plug 1*a*, in which the fuse 14 is already blown as shown in FIG. 4(B), has been replaced.

Figure 6:
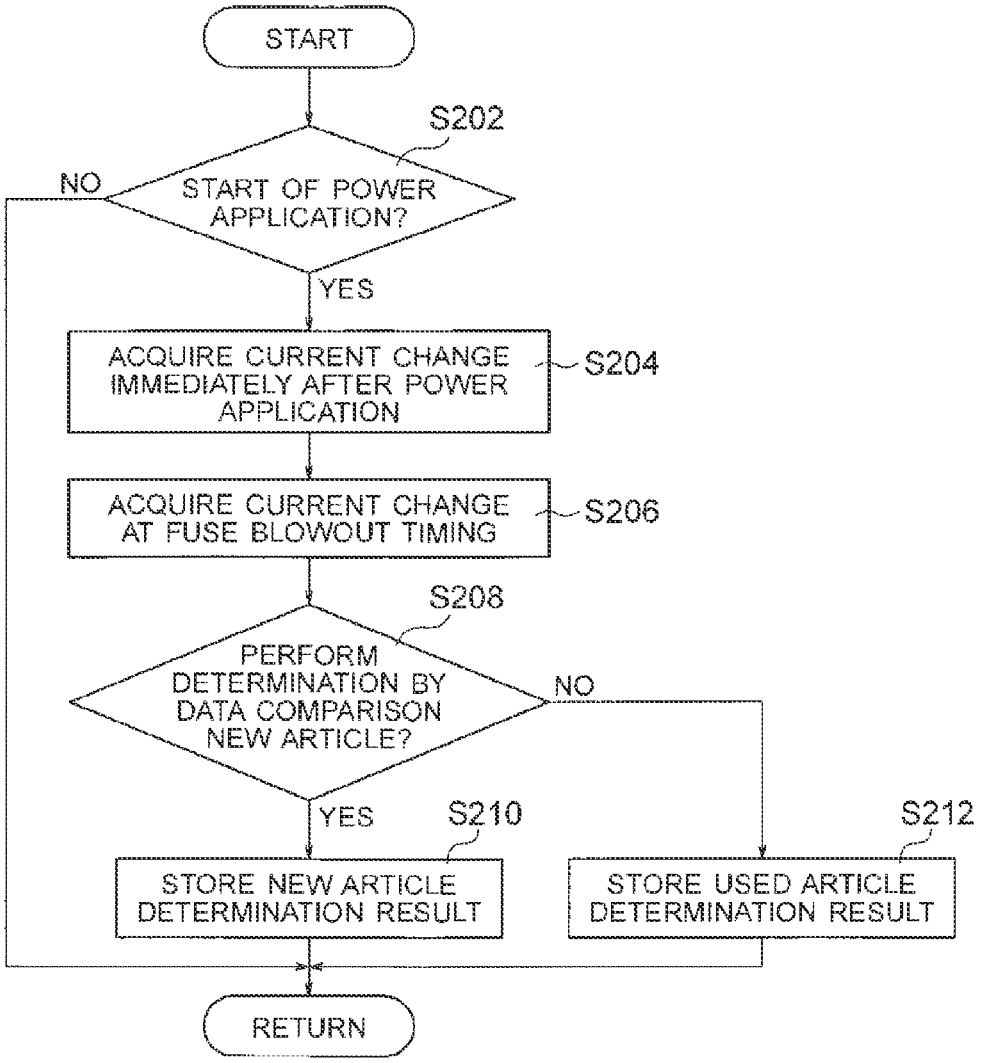
FIG. 6 is a subroutine flowchart showing the procedure of a new glow plug determination process according to the embodiment of the invention that is performed by the glow plug control unit when a used glow plug is used.

In addition, preferably, a series of processing shown in FIG. 6 is started only when a predetermined command is input to the GCU 100 or when a predetermined flag is set in the GCU 100 before the start of power application to the glow plug after the replacement of the glow plug.

For the input of a predetermined command to the GCU 100 or the setting of a predetermined flag in the GCU 100, it is preferable that the GCU 100 be made to be able to receive a command or set a flag to start a series of processing shown in FIG. 6 through a predetermined switch operation or the like in a state where an in-vehicle electronic control unit that performs operation control or fuel injection control of the engine (not shown) is, for example, in a failure diagnosis mode.

When the process is started by the arithmetic control unit 33, it is determined whether or not power application to the glow plug 1*a* has been started (refer to FIG. 4(B) and step S202 in FIG. 6). When it is determined that the power application has been started (in the case of YES), the process proceeds to step S204 to be described below. When it is determined that the power application has not been started yet (in the case of NO), the process is ended without performing the series of processing and returns to the main routine (not shown).

In step S204, a current change immediately after power application is acquired. That is, as in the processing of step S104 in FIG. 5, a current value with respect to the passage of time during a period for which an inrush current is generated is acquired at a predetermined sampling timing and is stored in the appropriate storage region of the arithmetic control unit 33.

In addition, it is preferable that the setting of the specific sampling period in this step S204 be performed according to the case of step S104 described above.

Then, a current change is acquired at the fuse blowout timing (refer to step S206 in FIG. 6).

That is, as described above in step S106 (refer to FIG. 5), a current change of the glow plug 1*a* at a timing corresponding to the period before and after it is assumed that the fuse 14 is blown is acquired.

As previously described as a prerequisite, when the glow plug 1*a* in which the fuse 14 is already blown or a glow plug (not shown) having a conventional structure is connected, the current change acquired in step S206 is not like the range surrounded by the dotted circle with the reference sign B in FIG. 7 described above but approximates to the characteristic line shown by the two-dot chain line in FIG. 7.

Then, the current change immediately after power application acquired as described above and the current change at the fuse blowout timing are compared with the similar data stored in the arithmetic control unit 33 by the process shown in FIG. 5 as described above, and it is determined whether or not the corresponding article is a new article (refer to step S208 in FIG. 6).

For the comparison between the current change acquired in steps S204 and S206 and the similar data stored in the arithmetic control unit 33, it is preferable to determine whether or not the current change acquired in steps S204 and S206 approximates to the similar data stored in the arithmetic control unit 33 in a predetermined allowable range and to perform determination as a new article when the current change approximates to the similar data in the predetermined allowable range and perform determination as a used article in other cases.

Then, when determination as a new article is made as described above (in the case of YES), the determination result is stored in the appropriate storage region of the arithmetic control unit 33 together with the current change acquired in steps S204 and S206 (refer to step S210 in FIG. 6).

On the other hand, when determination as a used article is made in step S208 (in the case of NO), the determination result is stored in the appropriate storage region of the arithmetic control unit 33 together with the current change acquired in steps S204 and S206 (refer to step S212 in FIG. 6).

Then, the series of processing is ended after the processing of S210 or S212, and the process returns to the main routine (not shown).

A determination result stored in the appropriate storage region of the arithmetic control unit 33 may be checked by connecting a tester (not shown) to the GCU 100 and extracting the data in the storage region of the arithmetic control unit 33, or may be checked in a failure diagnosis mode using an in-vehicle electronic control unit (not shown).

In the new glow plug determination method described using FIGS. 5 and 6, a current change during a period of generation of inrush current to the glow plug 1 before the fuse 14 is blown and a current change in the blowout timing of the fuse 14 are acquired and stored, and the same current changes are acquired at the time of replacement of a glow plug and are compared with the stored data in order to determine whether or not the glow plug is a new article. However, a determination factor as to whether or not the corresponding glow plug is a new article does not need to be limited to the current change. For example, a change in the resistance of the glow plug 1 during the inrush current generation period and a change in the resistance of the glow plug 1 at the blowout timing of the fuse 14 may be used to determine whether or not the corresponding glow plug is a new article as in the case of the above-described current change. In this case, as described above in step S108 in FIG. 5, the resistance of the glow plug 1 can be calculated by the arithmetic control unit 33 on the basis of the data and the like acquired through the current measuring circuit 32.

In addition, although the ceramic type glow plug has been described as an example in the embodiment of the invention, the invention is not limited to this and can also be applied to other types of glow plugs.

In addition, in the embodiment of the invention, the calculation processing shown in FIGS. 5 and 6 is performed on the assumption that the GCU 100 is configured to include the arithmetic control unit 33. However, the GCU 100 may be configured not to include the arithmetic control unit 33. In this case, it is preferable that an electronic control unit for vehicle operation control (not shown), which performs fuel injection control or the like of a vehicle, perform the processing described in FIGS. 5 and 6 instead of the arithmetic control unit 33.

According to the glow plug of the invention, since a configuration is adopted in which an additional circuit that does not affect the original electrical characteristics in a normal use state is added, it can be easily determined whether or not the glow plug is a new article in conjunction with a unit testing method of a glow plug having such a configuration. As a result, since it is possible to eliminate a possibility that a used article will be mounted as much as possible, there is an effect that it can contribute to improving the reliability of the entire vehicle device.

According to the new glow plug determination method and the glow plug driving control device of the invention, since whether or not a replaced glow plug is a new article can be easily determined, there is an effect that the use of a used article can be reliably eliminated.

Since a glow plug can be easily inspected, the invention is suitable for a vehicle for which improvements in the reliability are required.

What is claimed is:

1. A new article determination method for an in-vehicle glow plug in which an additional circuit formed by connecting a diode, a fuse, and a resistor in series in this order is connected in parallel to a heating element and the diode is provided so as to have an anode located on a positive electrode side of the heating element and a cathode located on the fuse side, the method comprising:

acquiring and storing, at the time of first power application after the glow plug is mounted in a vehicle, a change of a power state when an inrush current is generated and when the fuse is blown;

acquiring, at the time of power application after the glow plug is replaced, a change of a power state at the same timing as when the inrush current is generated and when the fuse is blown; and comparing each acquired change of a power state with the stored change of a power state at the time of first power application to determine whether or not the glow plug is a new article.

2. The new glow plug determination method according to claim 1, wherein the change of a power state is a change in current with respect to passage of time.

3. The new glow plug determination method according to claim 1, wherein the change of a power state is a change in resistance with respect to passage of time.

4. A glow plug driving control device comprising:

an arithmetic control unit that performs driving control of a glow plug; and a power driving circuit that powers the glow plug up according to the glow plug driving control performed by the arithmetic control unit, wherein, in the glow plug, an additional circuit formed by connecting a diode, a fuse, and a resistor in series in this order is connected in parallel to a heating element, and the diode is provided so as to have an anode located on a positive electrode side of the heating element and a cathode located on the fuse side, at the time of first power application after the glow plug is mounted in a vehicle, a change of a power state when an inrush current is generated and when the fuse is blown is acquired and stored, at the time of power application after the glow plug is replaced, each change of a power state is acquired at the same timing as when the inrush current is generated and when the fuse is blown, and each acquired change of a power state is compared with the stored change of a power state at the time of first power application to determine whether or not the glow plug is a new article.

5. The glow plug driving control device according to claim 4, wherein the change of a power state is a change in current with respect to passage of time.

6. The glow plug driving control device according to claim 4, wherein the change of a power state is a change in resistance with respect to passage of time.

* * * * *